US008422919B2

(12) United States Patent
Eck et al.

(10) Patent No.: US 8,422,919 B2
(45) Date of Patent: Apr. 16, 2013

(54) SUPPLYING ELECTROPHOTOGRAPHIC TONING MEMBER USING RIBBON BLENDER

(75) Inventors: Edward Michael Eck, Lima, NY (US); Wendy Buhay, Clifton Springs, NY (US)

(73) Assignee: Eastman Kodak Company, Rochester, NY (US)

( * ) Notice: Subject to any disclaimer, the term of this patent is extended or adjusted under 35 U.S.C. 154(b) by 265 days.

(21) Appl. No.: 13/014,900

(22) Filed: Jan. 27, 2011

(65) Prior Publication Data

US 2012/0195646 A1 Aug. 2, 2012

(51) Int. Cl.
*G03G 15/08* (2006.01)
*G03G 15/09* (2006.01)

(52) U.S. Cl.
USPC ..... 399/254; 399/272

(58) Field of Classification Search ..... 399/254–256, 399/272
See application file for complete search history.

(56) References Cited

U.S. PATENT DOCUMENTS 4,634,286 A 1/1987 Pike
5,146,277 A 9/1992 Fox
6,608,641 B1 8/2003 Alexandrovich et al.
7,120,379 B2 10/2006 Eck
7,137,730 B2 * 11/2006 Eck et al. ..... 399/256
7,248,823 B2 * 7/2007 Buhay-Kettelkamp et al. ..... 399/254
7,426,361 B2 9/2008 Thompson et al.
7,792,467 B2 9/2010 Stelter et al.
2002/0168200 A1 11/2002 Stelter et al.
2006/0133870 A1 6/2006 Ng et al.

OTHER PUBLICATIONS

U.S. Appl. No. 11/075,784, filed Mar. 9, 2005, Stelter et al.

* cited by examiner

*Primary Examiner* — William J Royer
(74) *Attorney, Agent, or Firm* — Christopher J. White

(57) ABSTRACT

A toning apparatus for an electrophotographic marking engine using multi-component developer includes a magnet for producing a magnetic field through the surface of a toning member, so that carrier particles in the developer in a receiving zone are attracted to the toning member. A rotatable ribbon blender includes an axle, a first inner ribbon and a first outer ribbon having opposite handednesses of twist and arranged to rotate with the axle, and a paddle connected to the first outer ribbon. The ribbon blender is disposed at least partially in the developer in a sump, so that when the ribbon blender rotates, the paddle transports developer from the sump to the receiving zone. No feed roller or supply roller is required; the ribbon blender mixes and transports developer.

10 Claims, 4 Drawing Sheets

SUPPLYING ELECTROPHOTOGRAPHIC TONING MEMBER USING RIBBON BLENDER

FIELD OF THE INVENTION

This invention pertains to the field of electrophotographic printing and more particularly to transporting developer 235 in a printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

FIG. 2 shows an embodiment of a development station for bringing toner particles into the vicinity of the photoreceptor. Belt photoreceptor 25 is adjacent to development station 23, which includes toning roller 210, feed roller 220, and sump 230. Sump 230 contains developer 235 including toner particles. Feed roller 220 includes protrusions 225 for carrying developer from sump 230 to toning roller 210. Metering skive 214 is spaced apart from toning roller 210 to permit an appropriate amount of developer to pass to toning zone 217, in which toner is transported to photoreceptor 25. Mixer 237 rotates to tribocharge and mix developer 235. An example of a system using a feed roller is given in U.S. Pat. No. 7,792,467.

Other printers using feed rollers are various models in the KODAK DIGIMASTER EX series, such as the EX 110. This printer uses a ribbon blender to provide toner to the toning roller. The ribbon blender has two paddles, each about five inches long, that are set 180° around the blender from each other.

SUMMARY OF THE INVENTION

Still referring to FIG. 2, multi-component developers that include toner particles and magnetic carrier particles are commonly used in development stations. The development station brings developer into proximity with the latent image on the photoreceptor. The magnetic carrier particles are used to bring the toner particles closer to the latent image to reduce the force required to transfer them, and thus produce a visible image which more completely fills the toner areas of the latent image. Although the magnetic carrier particles are used to move toner particles, they are themselves conventionally moved by mechanical devices, such as protrusions 225. Moreover, multi-component developers require one or more mixer(s) 237 to keep toner particles and carrier particles uniformly mixed throughout sump 230. Any deficiency of toner particles being carried to toning roller 210 can result in an objectionably less-dense area of the final print. Furthermore, some multi-component systems use permanently-magnetized carrier particles, increasing the energy required to move them with respect to each other, and therefore increasing the power requirement of the mixer. There is an opportunity, therefore, for an improved device for mixing and transporting toner that takes advantage of the magnetic character of the carrier particles.

According to the present invention, therefore, there is provided a toning apparatus for an electrophotographic marking engine, comprising:

a. a rotatable toning member for transporting developer, the toning member including an axle, the developer including toner particles and magnetic carrier particles;

b. a receiving member arranged with respect to the toning member so that a toning zone is defined in which toner particles are transferred from the toning member to the receiving member, and a receiving zone is defined on the toning member prior to the toning zone in the direction of rotation of the toning member;

c. a magnet for producing a magnetic field through the surface of the toning member in the receiving zone, so that the carrier particles in the developer in the receiving zone are attracted to the toning member;

d. a sump for holding developer;

e. a rotatable ribbon blender including an axle, a first inner ribbon and a first outer ribbon having opposite handednesses of twist and arranged to rotate with the axle, and a paddle connected to the first outer ribbon, the ribbon blender disposed at least partially in the developer in the sump, so that when the ribbon blender rotates, the paddle transports developer from the sump to the receiving zone.

An advantage of this invention is that it does not require a supply roller with mechanical protrusions. The ribbon blender mixes more effectively than conventional mixers, and direct transport to the toning member saves the power that would otherwise be used to drive a supply member. Various embodiments permit a constant sump level to be used, so they do not require tilting the axis of the ribbon blender or the toning member to account for variations in toner concentration along the length of the ribbon blender. This also permits wider load latitudes. In various embodiments, the axle of the ribbon blender is not in the developer in the sump. This reduces friction on the ribbon blender compared to a fully-submerged blender, further reducing the power required to operate the blender. In various embodiments, the ribbon blender is no longer than the toning member, reducing the space required for the toning apparatus compared to conventional schemes in which the blender extends past the ends of the toning member, or in which a separate mixing area apart from the feed roller is required. Using paddles on the ribbon blender permits the ribbon blender to be spaced farther from the inside wall of the sump than systems without paddles, and still maintains an effective flow of developer in the sump. This relaxes manufacturing tolerances on the blender and the sump.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
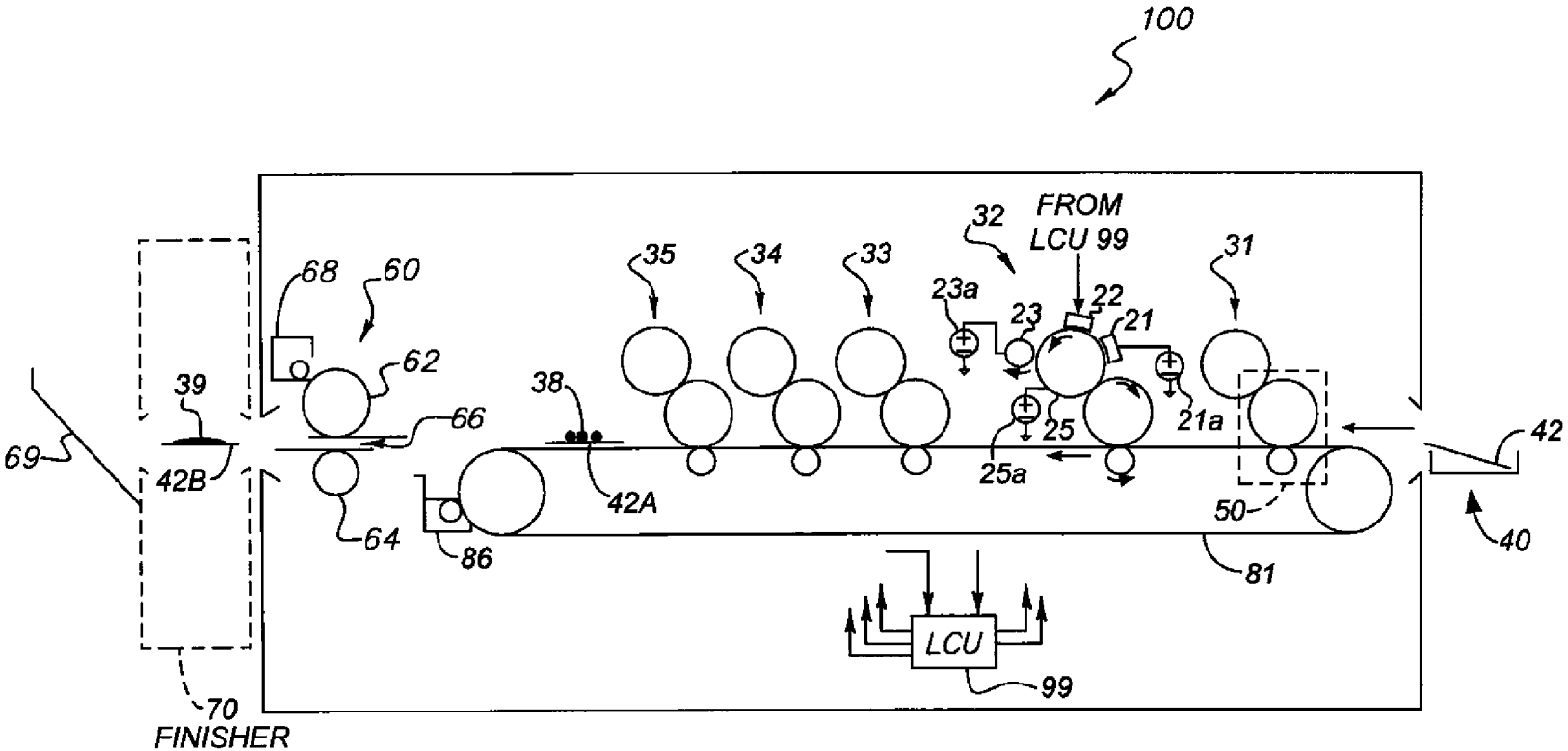
FIG. 1 is an elevational cross-section of an electrophotographic reproduction apparatus suitable for use with various embodiments.

The attached drawings are for purposes of illustration and are not necessarily to scale.

DETAILED DESCRIPTION OF THE INVENTION

As used herein, the terms "parallel" and "perpendicular" have a tolerance of ±10°. The term "coaxial" has a translational tolerance of ±10% in any direction and an angular tolerance of ±5° in any direction.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color onto a receiver. A printer can also produce selected patterns of toner on a receiver, which patterns (e.g., surface textures) do not correspond directly to a visible image. The DFE receives input electronic files (such as Postscript command files) composed of images from other input devices (e.g., a scanner, a digital camera). The DFE can include various function processors, e.g., a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g., the electrophotographic process) to provide known, consistent color reproduction characteristics. The color management system can also provide known color reproduction for different inputs (e.g., digital camera images or film images).

In an embodiment of an electrophotographic modular printing machine useful with various embodiments, e.g., the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. These colorants are present in colored toners in selected amounts to provide a desired full-field density and chromaticity when deposited on the receiver. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-sections showing portions of a typical electrophotographic printer 100 useful with various embodiments. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

The term "printer" includes electrophotographic printers and copiers that employ dry toner developed on an electrographic receiver element, as well as ionographic printers and copiers that do not rely upon an electrographic receiver. The term also includes powder applicators for applying powder materials, as described in U.S. Ser. No. 11/075,784 entitled POWDER COATING APPARATUS AND METHOD OF POWDER COATING USING AN ELECTROMAGNETIC BRUSH, filed on Mar. 9, 2005, the disclosure of which is incorporated by reference herein.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film. In other embodiments not shown, Printer 100 can include one or more printing modules (e.g., printing module 32)

Each printing module 31, 32, 33, 34, 35 includes various components. For clarity, these are only shown in printing module 32. Around photoreceptor 25 are arranged, ordered by the direction of rotation of photoreceptor 25, charger 21, exposure subsystem 22, and development station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by development station 23 and are attracted to the latent image to develop the latent image into a visible image. Note that the visible image may not be visible to the naked eye depending on the composition of the toner particles (e.g. clear toner). Development station 23 can also be referred to as a toning station. Toner can be applied to either the charged or discharged parts of the latent image.

Similarly, electrostatically chargeable powder particles are developed, preferably directly onto a substrate on which the final coating is subsequently fixed. In an embodiment, thermosetting powder particles are used.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g., for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g., color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to development station 23 by voltage source 23*a* to control the electric field, and thus the rate of toner transfer, from development station 23 to photoreceptor 25. In an embodiment, a voltage is applied to a conductive base layer of photoreceptor 25 by voltage source 25*a* before development, that is, before toner is applied to photoreceptor 25 by development station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. Any of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 3:
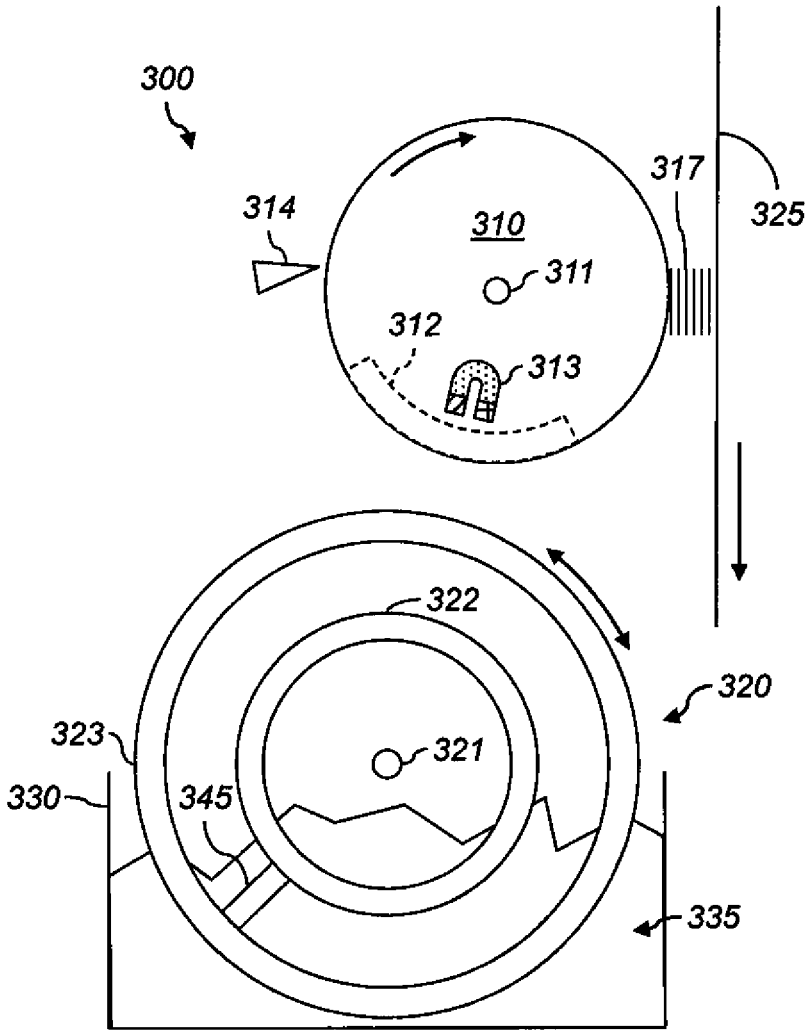
FIG. 3 shows an embodiment of toning apparatus for an electrophotographic marking engine.

FIG. 3 shows an embodiment of toning apparatus 300 for an electrophotographic marking engine. Rotatable toning member 310 transports developer, and includes axle 311. Toning member 310 can be a drum, as shown. Toning member 310 can also be a belt entrained around one or more rollers, in which case axle 311 is the axle of the belt roller closest to ribbon blender 320. Developer 335 includes toner particles and magnetic carrier particles and is held by sump 330.

Receiving member 325 is arranged with respect to toning member 310 so that a toning zone 317 is defined in which toner particles are transferred from toning member 310 to receiving member 325. Receiving member 325 can be or include a photoreceptor (e.g., drum or belt), or a metal sheet, adapted to receive the transferred toner particles. Receiving zone 312 is defined on toning member 310 prior to toning zone 317 in the direction of rotation of toning member 310. In receiving zone 312, developer is brought to toning member 310.

Magnet 313, represented graphically as a horseshoe magnet, produces a magnetic field through the surface of toning member 310 in receiving zone 312. This magnetic field attracts the carrier particles in the developer 335 to toning member 310 in receiving zone 312. Magnet 313 can be a magnetic core, described below, or can be located within or outside the circumference of toning member 310. Magnet 313 includes one or more permanent magnet(s) or electromagnet(s) arranged with respect to each other to provide a desired magnetic field.

In various embodiments, receiving zone 312 is followed (as toning member 310 rotates) by metering skive 314. Metering skive 314 permits a selected amount of the developer 335 on toning member 310 to pass from receiving zone 312 to toning zone 317. Metering skive 314 can be a fixed blade parallel to toning member 310, and held at a fixed spacing apart from the surface of toning member 310.

Rotatable ribbon blender 320 includes axle 321, first inner ribbon 322 and first outer ribbon 323. First inner ribbon 322 and first outer ribbon 323 are wrapped around axle 321, are arranged to rotate with axle 321, and have opposite handednesses of twist. That is, when axle 321 rotates, first inner ribbon 322 and first outer ribbon 323 both rotate in the same direction that axle 321 is rotating. However, they exert a force on developer 335 in opposite directions. This will be discussed further below with reference to FIG. 4. The length of the ribbon blender 320 is measured into and out of the page of the view in FIG. 3.

As used herein, "ribbon" refers to any elongated element formed or bent around an axis of rotation so that, as the ribbon rotates around the axis of rotation, it exerts a force on matter with which it is in mechanical contact along the axis of rotation. Ribbons can be helices, approximations of helices using straight segments, or combinations. Ribbons can be formed by extrusion and can be combined with other elements. For example, two ribbons can be connected by a segment normal to the axis of rotation. That the joining segment does not exert a force along the axis of rotation does not mean that the force-exerting elements it joins are not ribbons.

Paddle 345 is connected to first outer ribbon 323. Ribbon blender 320 is disposed at least partially in developer 335 in sump 330. That is, ribbon blender 320 is arranged with respect to sump 330 so that when a normal load of developer 335 is in sump 330, each of first inner ribbon 322 and first outer ribbon 323 is in physical contact at least one point with developer 335 in sump 330. Therefore, when ribbon blender 320 rotates, paddle 345 transports developer 335 from sump 330 to receiving zone 312 of toning member 310. In an embodiment, the speed of rotation of ribbon blender 320 is selected so that paddle 345 flings developer 335 towards toning member 310. The magnetic field from magnet 313 then attracts the carrier particles in the flung developer to draw them to toning member 310 in receiving zone 312. In this way, no feed roller or supply roller is required; the ribbon blender 320 mixes and transports developer 335.

Using paddles can provide effective developer flow with relaxed tolerances. In the KODAK DIGIMASTER 9110 and 9150, a ribbon blender was used without paddles. The outside radius of outer ribbon 323 was spaced approximately 0.045" (1.143 mm) from the inside wall of sump 330. In models in the KODAK DIGIMASTER EX series using a ribbon blender 320 with paddles 345, the spacing is in the range of approximately 0.07" (~1.778 mm) to approximately 0.09" (~2.286 mm). In various embodiments, these wider spacings are used, and permit relaxing the manufacturing tolerances on sump 330 and ribbon blender 320 compared to the previous printer. Moreover, increasing the spacing can make the flow less sensitive to the surface roughness of the inside of the sump, easing the manufacturing requirements for that surface and permitting lower-cost production techniques to be used.

In various embodiments, axle 321 of ribbon blender 320 is coaxial with first inner ribbon 322 and first outer ribbon 323. This is not required, however. In other embodiments, the ribbons 322, 323 are mounted on axle 321 off-center and the rotation speed of ribbon blender 320 is increased compared to the coaxial case.

In various embodiments, axle 321 of ribbon blender 320 is parallel to axle 311 of toning member 310. The top of developer 335 in sump 330 is preferably substantially constant in these embodiments. The ribbon blender 320 mixes the developer 335 to a sufficient extent that toner concentration changes along the length of ribbon blender 320 do not substantially affect performance. In various embodiments, a plurality of paddles 345 is arranged along the length of ribbon blender 320 at regular or irregular intervals. Developer 335 is therefore removed from the sump 330 down the length of ribbon blender 320, reducing linear nonuniformity in toner concentration. In various embodiments, one or more paddle(s) 345 extend at least the full length of ribbon blender 320, or at least the full length of toning member 310. In one example, two paddles 345 set 180° apart around ribbon blender 320 both extend the full length of toning member 310. In various embodiments, first inner ribbon 322 and first outer ribbon 323 have respective, constant radii. In other embodiments, first inner ribbon 322 or first outer ribbon 323 (or both) tapers. A tapered ribbon has a radius that changes along the length of ribbon blender 320. The plot of radius versus distance along the length of ribbon blender 320 can be any function, not just a linear taper. Sinusoidal profiles can also be used. Multiple profiles can be combined. The inner and outer radii of the ribbons 322, 323 can be constant or variable. In various embodiments, paddle 345 is contained between the radius of first outer ribbon 323 and the radius of first inner ribbon 322. That is, in these embodiments, paddle 345 does not protrude into sump 330 beyond the outer radius of first outer ribbon 323, or protrude closer to axle 321 than the inner radius of first inner ribbon 322. In other embodiments, paddle 345 protrudes beyond the outer radius of first outer ribbon 323.

Ribbon blender 320 can be rotated at a variety of speeds. In an embodiment, ribbon blender 320 is rotated at an angular velocity within 25% above or below twice the angular velocity of toning member 310. In other embodiments, ribbon blender 320 is rotated at 300 rpm, 350 rpm, or 450 rpm. In some embodiments using full-length paddles, as described above, ribbon blender 320 is rotated with a lower angular velocity than a blender with partial-length paddles would be, e.g., <300 rpm.

In various embodiments, toning member 310 is rotating or stationary, or includes a toning shell that is rotating or stationary, for applying toner of a selected color to the latent image on receiving member 325 to produce a visible image on receiving member 325. Toner is transferred by electrostatic forces from toning member 310 to receiving member 325. These forces can include Coulombic forces between charged toner particles and the charged electrostatic latent image, and Lorentz forces on the charged toner particles due to the electric field produced by the bias voltages.

In various embodiments, developer 335 is a multi-component developer that includes toner particles and magnetic carrier particles. The "toner concentration" of the developer is the percentage of toner in the developer, by mass or volume. Toning member 310 can include a magnetic core (not shown) to cause the magnetic carrier particles near toning member 310 to form a "magnetic brush," as known in the electrophotographic art. The magnetic core can be stationary or rotating, and can rotate with a speed and direction the same as or different than the speed and direction of toning member 310 or a toning shell thereof. The magnetic core can be cylindrical or non-cylindrical, and can include a single magnet or a plurality of magnets or magnetic poles disposed around its circumference. Alternatively, the magnetic core can include an array of solenoids driven to provide a magnetic field of alternating direction. The magnetic core preferably provides a magnetic field of varying magnitude and direction around the outer circumference of toning member 310. Further details of a magnetic core can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Developer 335 can also include toner particles or other particles with various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remnance, florescence, resistance to etchants, and other properties of additives known in the art.

Figure 4:
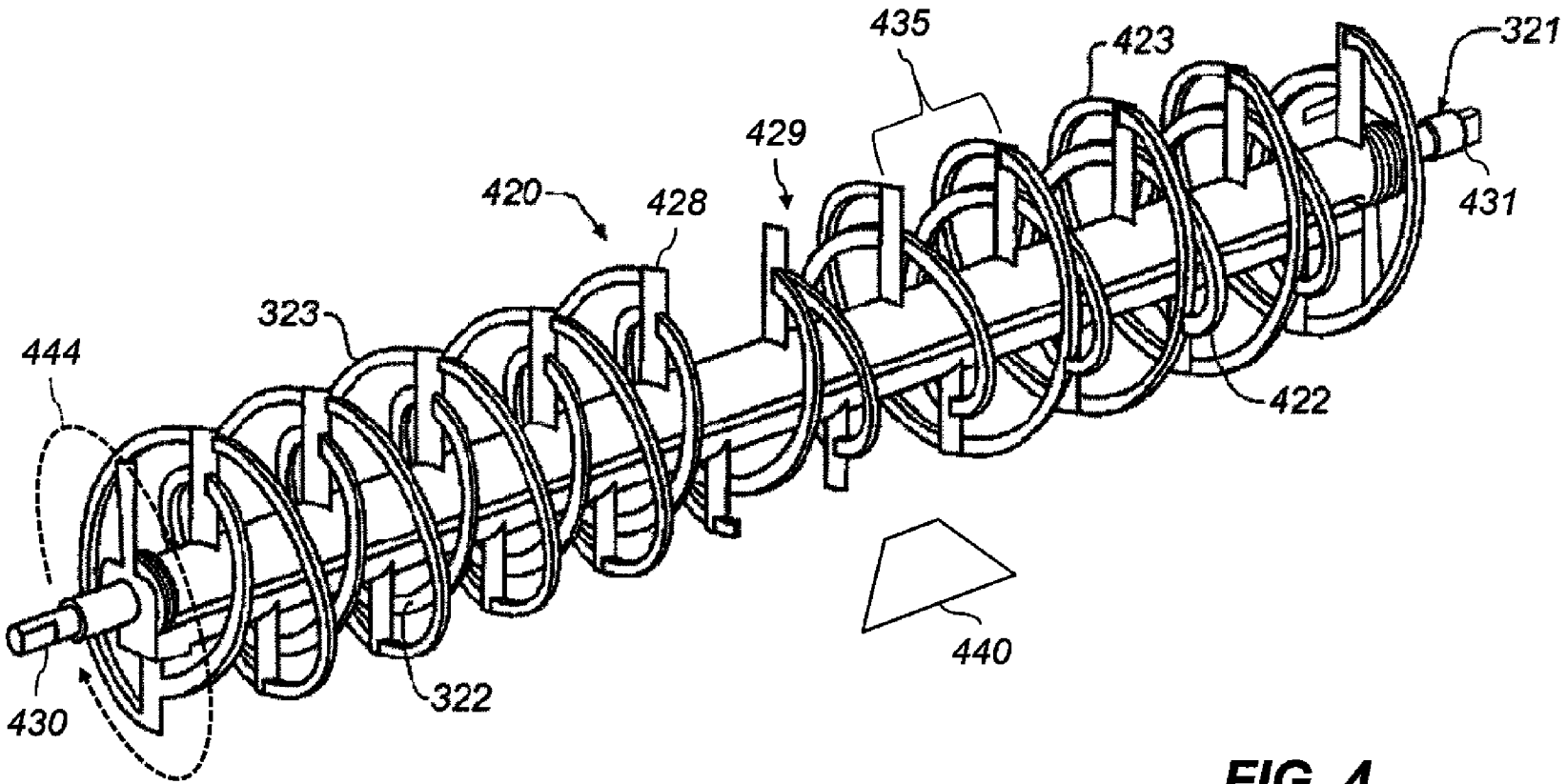
FIG. 4 shows features of various embodiments of ribbon blenders.

FIG. 4 shows features of various embodiments of ribbon blender 420. Note that paddles 345 (FIG. 3) are omitted from this figure for clarity. Axle 321, first inner ribbon 322, and first outer ribbon 323 are as shown in FIG. 3. Ribbon blender 420 further includes second inner ribbon 422 and second outer ribbon 423 having opposite handednesses of twist, as discussed above. First inner ribbon 322 and second inner ribbon 422 are coaxial, and first outer ribbon 323 and second outer ribbon 423 are coaxial. The two sets of ribbons are arranged in different portions of the length of axle 321. In various embodiments, the inner ribbons meet at intermediate location 429. In various embodiments, the outer ribbons 323, 423 meet at an intermediate location (not shown), or ribbons can form a prow where they meet. In various embodiments, the two inner ribbons 322, 422 are mirror-images of each other, and the two outer ribbons 323, 423 are mirror-images of each other, so that the flow of developer in sump 330 (FIG. 3) is balanced. Balanced flow promotes more uniform mixing. Ribbon blender 420, as shown here, includes mirror-image inner and outer ribbons.

In various embodiments, axle 321 of ribbon blender 420 is coaxial with second inner ribbon 422 and second outer ribbon 423. In various embodiments, supports 428 are used to attach the ribbons to the axle 321 of the ribbon blender 420.

In an embodiment, ribbon blender 420 generally provides a flow pattern of developer described U.S. Pat. No. 4,634,286 entitled Electrographic Development Apparatus Having a Continuous Coil Ribbon Blender, issued Jan. 6, 1987, the disclosure of which is incorporated herein by reference, and particularly FIG. 3 thereof. The ribbons 322, 323, 422, 423 can be continuous or have multiple segments. Further details of a ribbon blender are provided in U.S. Pat. No. 5,146,277, the disclosure of which is incorporated herein by reference.

Still referring to FIG. 4, first inner ribbon 322 and first outer ribbon 323 have opposite handednesses. In this example, the pitch of first inner ribbon 322 is the negative of the pitch of first outer ribbon 323. "Pitch" refers to the distance travelled by a mass of developer being pushed by a ribbon in one rotation of the ribbon, assuming the only motion of the mass is motion parallel to the axis of rotation of the ribbon. In one example, ribbon blender 420 is rotating as indicated by arrow 444 (clockwise when viewed from end 430 to end 431). First inner ribbon 322 is moving developer towards end 431, and first outer ribbon 323 is moving developer towards end 430. One full rotation of each ribbon takes the same distance along axle 321 (e.g., span 435). The pitches for the inner and outer ribbon or ribbons can be the same or different. For example, the inner ribbon can have half the pitch of the outer ribbon, so the inner ribbon has two revolutions in the same span as one revolution of the outer ribbon.

Figure 2:
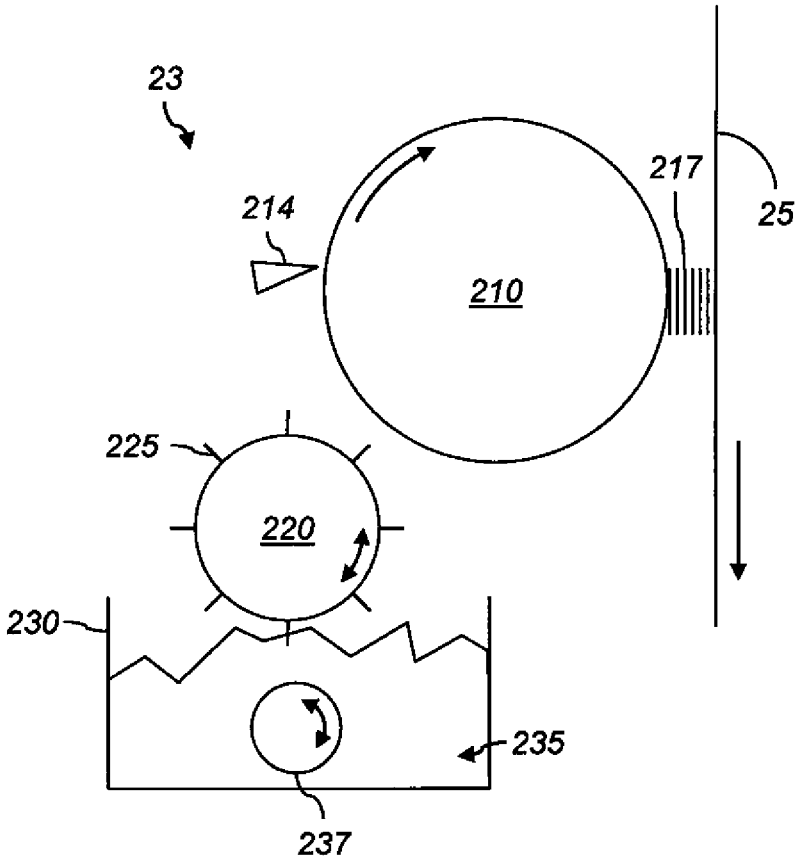
FIG. 2 (PRIOR ART)
FIG. 2 shows an embodiment of a conventional development station.

In various embodiments, replenisher 440 (represented graphically in this figure) is disposed adjacent to the middle of the ribbon blender 420. Replenisher 440 is adapted to add toner to sump 330 (FIG. 3) when the level of toner in developer 335 (FIG. 2) is below a desired range. Replenisher 440 can include a canister and an auger for selectively drawing toner out of the canister and depositing it into the developer 335. By "adjacent to the middle" it is meant that replenisher 440 is positioned so that when it adds toner to developer 335, some of the freshly-added toner is drawn towards each end of the ribbon blender by the ribbons.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

Parts List

21 charger
21*a* voltage source
22 exposure subsystem
23 development station
23*a* voltage source
25 photoreceptor
25*a* voltage source
31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
210 toning roller
214 metering skive
217 toning zone
220 feed roller
225 protrusions
230 sump
Parts List—Continued
235 developer
237 mixer
300 toning apparatus
310 toning member
311 axle
312 receiving zone
313 magnet
314 metering skive
317 toning zone
320 ribbon blender
321 axle
322 first inner ribbon
323 first outer ribbon
325 receiving member
330 sump
335 developer
345 paddle
420 ribbon blender
422 second inner ribbon
423 second outer ribbon
428 support
429 intermediate location
430, 431 end
435 span
440 replenisher
444 arrow

The invention claimed is:

1. Toning apparatus for an electrophotographic marking engine, comprising:

a. a rotatable toning member for transporting developer, the toning member including an axle, the developer including toner particles and magnetic carrier particles;

b. a receiving member arranged with respect to the toning member so that a toning zone is defined in which toner particles are transferred from the toning member to the receiving member, and a receiving zone is defined on the toning member prior to the toning zone in the direction of rotation of the toning member;

c. a magnet for producing a magnetic field through the surface of the toning member in the receiving zone, so that the carrier particles in the developer in the receiving zone are attracted to the toning member;

d. a sump for holding developer;

e. a rotatable ribbon blender including an axle, a first inner ribbon and a first outer ribbon having opposite handednesses of twist and arranged to rotate with the axle, and a paddle connected to the first outer ribbon, the ribbon blender disposed at least partially in the developer in the sump, so that when the ribbon blender rotates, the paddle transports developer from the sump to the receiving zone on the toning member.

2. The apparatus according to claim 1, wherein the axle of the ribbon blender is coaxial with the first inner ribbon and the first outer ribbon.

3. The apparatus according to claim 1, wherein the ribbon blender further includes a second inner ribbon and a second outer ribbon having opposite handednesses of twist, wherein the first and second inner ribbons are coaxial and the first and second outer ribbons are coaxial.

4. The apparatus according to claim 3, wherein the axle of the ribbon blender is coaxial with the second inner ribbon and the second outer ribbon.

5. The apparatus according to claim 1, wherein the receiving member includes a photoreceptor adapted to receive the transferred toner particles.

6. The apparatus according to claim 1, wherein the receiving member includes a metal sheet adapted to receive the transferred toner particles.

7. The apparatus according to claim 1, wherein the axle of the ribbon blender is parallel to the axle of the toning member.

8. The apparatus according to claim 1, wherein the first inner ribbon and the first outer ribbon have respective, constant radii.

9. The apparatus according to claim 8, wherein the paddle is contained between the radius of the first outer ribbon and the radius of the first inner ribbon.

10. The apparatus according to claim 1, further including a replenisher adapted to add toner to the sump adjacent to the middle of the ribbon blender.

* * * * *